US007669839B2

(12) United States Patent
McClaran

(10) Patent No.: US 7,669,839 B2
(45) Date of Patent: Mar. 2, 2010

(54) VACUUM HOLD DOWN

(76) Inventor: Michael Lloyd McClaran, 3616 Garden Ct., Chino Hills, CA (US) 91709

( * ) Notice: Subject to any disclaimer, the term of this patent is extended or adjusted under 35 U.S.C. 154(b) by 0 days.

(21) Appl. No.: 11/484,041

(22) Filed: Jul. 10, 2006

(65) Prior Publication Data

US 2008/0006975 A1 Jan. 10, 2008

(51) Int. Cl.
*B25B 11/00* (2006.01)

(52) U.S. Cl. ..... 269/21; 269/289 R

(58) Field of Classification Search ..... 269/21, 269/20, 289 R; 451/388; 279/3; 294/64.1
See application file for complete search history.

(56) References Cited

U.S. PATENT DOCUMENTS

| | | | | |
|---|---|---|---|---|
| 1,505,626 | A | 8/1924 | Debaecker | |
| 2,127,181 | A * | 8/1938 | Mattern | 294/64.1 |
| 2,234,121 | A * | 3/1941 | Hedeen | 280/153.5 |
| 2,680,994 | A | 6/1954 | Wood | |
| 2,782,574 | A | 2/1957 | Copold | |
| 4,049,484 | A * | 9/1977 | Priest et al. | 156/285 |
| 4,221,356 | A * | 9/1980 | Fortune | 248/363 |
| 4,428,815 | A * | 1/1984 | Powell et al. | 204/297.03 |
| 4,723,766 | A | 2/1988 | Beeding | |
| 4,778,326 | A * | 10/1988 | Althouse et al. | 414/800 |
| 4,906,011 | A | 3/1990 | Hiyamizu et al. | |
| 5,083,758 | A * | 1/1992 | Duke | 269/21 |
| 5,135,206 | A * | 8/1992 | Martinez | 269/21 |
| 5,177,857 | A | 1/1993 | Ito | |
| 5,222,719 | A | 6/1993 | Effner | |
| 5,553,837 | A | 9/1996 | Kahle | |
| 5,593,145 | A * | 1/1997 | Sprayberry | 269/3 |
| 5,987,729 | A | 11/1999 | Moran | |
| 6,089,801 | A | 7/2000 | Hardesty | |
| 6,098,937 | A * | 8/2000 | Carnahan et al. | 248/158 |
| 6,217,013 | B1 | 4/2001 | Foreman | |
| 6,257,564 | B1 * | 7/2001 | Avneri et al. | 269/21 |
| 6,286,822 | B1 * | 9/2001 | Blick | 269/21 |
| 6,655,671 | B2 * | 12/2003 | Iwaki | 269/21 |
| 6,764,258 | B1 * | 7/2004 | Akre | 409/219 |
| 6,796,014 | B2 * | 9/2004 | Sarh | 29/407.09 |
| 6,883,791 | B1 | 4/2005 | Liang et al. | |
| 6,889,967 | B2 | 5/2005 | Brown | |

* cited by examiner

*Primary Examiner*—Lee D Wilson
(74) *Attorney, Agent, or Firm*—Kenneth L. Green; Edgar W. Averill, Jr.

(57) ABSTRACT

A vacuum cup is made from rubber to resist damage and providing a vacuum seal without a separate gasket or O-ring. The vacuum cup may be one of several configurations suitable for different CNC machines and includes a rubber body comprising a bottom surface for mounting, a top surface including a vacuum area for holding a work piece, and a raised edge around the perimeter of the top surface for sealing against the work piece. The bottom surface may have any one of a variety of machine interfaces to cooperate with various machines. A vacuum passage connects the bottom surface with the vacuum area and a check valve may reside in the vacuum passage. The rubber body is sufficiently strong to resist flexing due to vacuum or work piece weight and the vacuum area includes work piece supports for contacting a work piece held on the vacuum cup.

18 Claims, 5 Drawing Sheets

VACUUM HOLD DOWN

BACKGROUND OF THE INVENTION

The present invention relates to vacuum hold downs and in particular to vacuum cups for CNC machines.

Various machines exist for performing operations on various types of materials. Vacuum is often used to hold the material in place while the operations are performed. Examples of such machines are Biesse machines made for boring and routing of engineered (for example, particle board) and solid wood, composited, plastics, and soft metals (for example, aluminum). These, and other machines, often utilize vacuum pods or cups which may be positioned for a particular work piece or operation. The cups may interface with the machine in various manners, and are generally approximately square and approximately six inches across, although the size and shape may vary.

Known cups are made from a phenolic material. Phenolic material is generally a plastic-like resin which is both hard and strong. Phenolic material is commonly used in as a wood worked surface, for example, as an insert for router tables, because cutters can cut into the phenolic material without damaging the cutter. Vacuum cups generally have narrow edges outlining the perimeter of a top surface of the cups for providing a vacuum seal, and cups made from the phenolic material are easily damaged when a cutter meets the narrow edges or when material is loaded onto the machine. The edges may be cracked, or a portion of the edge may break away. Unfortunately, even a small crack or chip is likely to spoil the cup's ability to maintain vacuum and prevent further use. The Phenolic (or similar hard material) also require a gasket to form a vacuum seal and material may slip on the hard surface. Such gaskets are often expensive and may easily be damaged.

BRIEF SUMMARY OF THE INVENTION

The present invention addresses the above and other needs by providing a vacuum cup made from rubber to resist damage and providing a vacuum seal without a separate gasket or O-ring. The vacuum cup may be one of several configurations suitable for different CNC machines and includes a rubber body comprising a bottom surface for mounting, a top surface including a vacuum area for holding a work piece, and a raised edge around the perimeter of the top surface for sealing against the work piece. The bottom surface may have any one of a variety of machine interfaces to cooperate with various machines. A vacuum passage connects the bottom surface with the vacuum area and a check valve may reside in the vacuum passage. The vacuum area further includes recessed work piece supports for contacting a work piece held on the vacuum cup when vacuum applied to the cup cause the raised edge to compress. The rubber material also reduces work piece slipping and allows higher feed speeds. In some cases, the rubber body is sufficiently strong to resist flexing due to vacuum or work piece weight and in other cases a strengthening insert, for example a Delrin® insert, is required to prevent flexing.

In accordance with one aspect of the invention, there is provided a vacuum cup comprising a substantially solid rubber body having a bottom surface, a top surface, and sides. A vacuum area is formed on the top surface and a vacuum passage passes between the bottom surface and the vacuum area. A raised edge resides around the top surface of the body for forming a seal with a work piece. Mounting features reside on the bottom surface for mounting the vacuum cup on a machine.

In accordance with another aspect of the invention, there is provided a vacuum cup comprising a substantially solid rubber body having a bottom surface, a top surface, and sides. A vacuum area is formed on the top surface and work piece supports reside in the vacuum area. A vacuum passage passes between the bottom surface and the vacuum area and a raised edge resides around a perimeter of the top surface of the body for forming a seal with a work piece. The raised edge is approximately 0.2 mm above the work piece supports. Mounting features are molded onto the bottom surface for positioning the vacuum cup on a machine.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
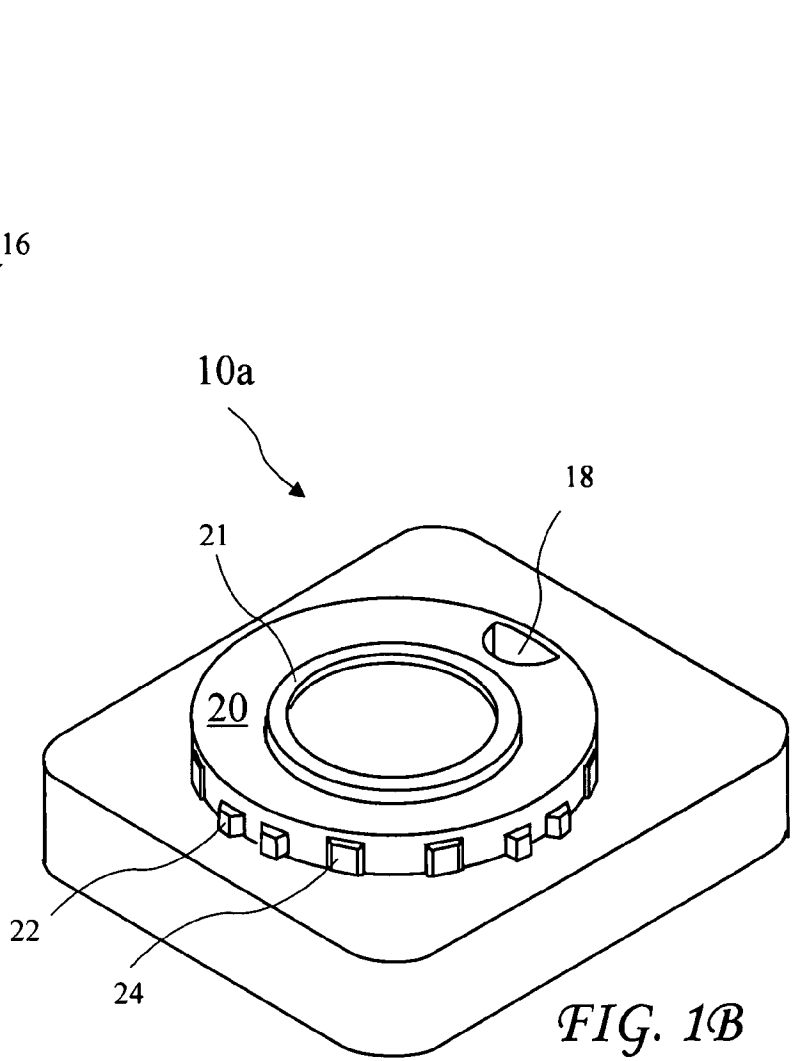
FIG. 1B is a bottom perspective view of the first embodiment of the vacuum cup according to the present invention.
Figure 1A:
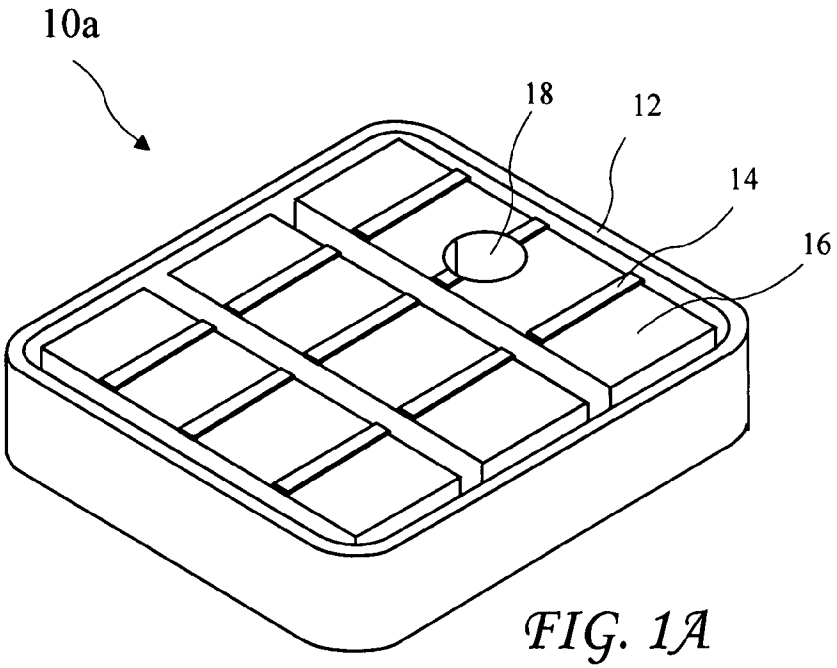
FIG. 1A is a top perspective view of a first embodiment of a vacuum cup according to the present invention.

A top perspective view of a first embodiment of a vacuum cup 10*a* according to the present invention is shown in FIG. 1A, and a bottom perspective view of the first embodiment of the vacuum cup 10*a* is shown in FIG. 1B. The top of the vacuum cup 10*a* includes a raised edge 12 for sealing with a work piece supported and held by the vacuum cup 10*a*, and raised work piece supports 14 for supporting the work piece. The work piece supports 14 preferably comprise a group of parallel bars and reside on support bases 16. A vacuum passage 18 passes through the vacuum cup 10*a* and connects to a vacuum source. The interior of the raised edge 12 defines a vacuum area for creating a hold down force for holding the work piece.

The bottom of the vacuum cup 10*a* includes a machine interface 20 for cooperating with known CNC machines, for example a Biesse Rover 22 CNC Machining Center or a Biesse Rover 24 CNC Machining Center. The machine interface 20 is a cylindrical protrusion and includes indexing features (or fingers) 22 for cooperation with indexing grooves in CNC machines, and centering pads 24 for cooperation with a corresponding opening in the CNC machines. The vacuum passage 18 is shown extending through the bottom of the vacuum cup 10*a*, and is partially blocked to provide a stop of a known check valve commonly used with vacuum cups.

Known vacuum cup are manufactured from a phenolic material. Phenolic material is generally a plastic-like resin which is both hard and strong. Unfortunately, such known cups break easily and must be replaced frequently. If a replacement is not available when needed, an expensive machine may be sit idle until a new part is obtained. The vacuum cup 10*a* according to the present invention is molded from substantially solid rubber and is much less susceptible to breaking. The vacuum cup according to the present invention is approximately one inch thick and preferably has a Shore hardness of approximately 80 Shore A. An example of a suitable material is compound number EXP7654-80B provided by R&S Processing in Paramount, Calif. Compound Number EXP7654-80B is a natural rubber and is non-blooming. Blooming refers to a tendency of some compounds to give off a powder like material. Such powder reduced friction and would reduce the holding power of the vacuum cups. The compound is crosshatched during molding to equalize shrinkage across the part. Such crosshatching is important to maintain close dimensional tolerances.

Because the material used by the present invention is not stiff like the phenolic material used in known vacuum cups, the vacuum cups 10*a* may flex when vacuum is applied. Such flexing often affects the seal between the material and the vacuum cup. As a result, a vacuum cup according to the present invention often requires additional support structure to prevent flexing. In the instance of the cup 10*a*, the additional support structure is a support ring 21 is added to the bottom of the cup. Such support ring 21 rests against a solid surface and thereby provides a support structure.

Figure 2:
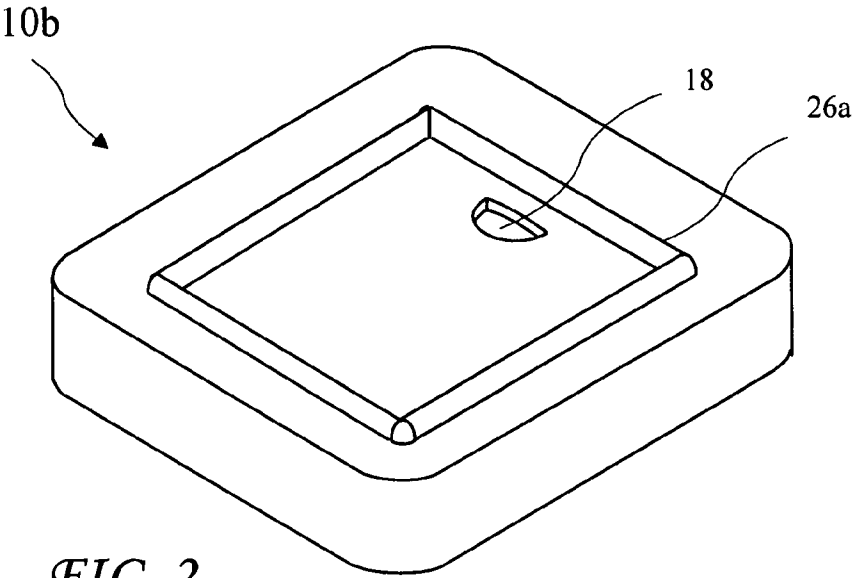
FIG. 2 is a bottom perspective view of a second embodiment of the vacuum cup according to the present invention.
Figure 3:
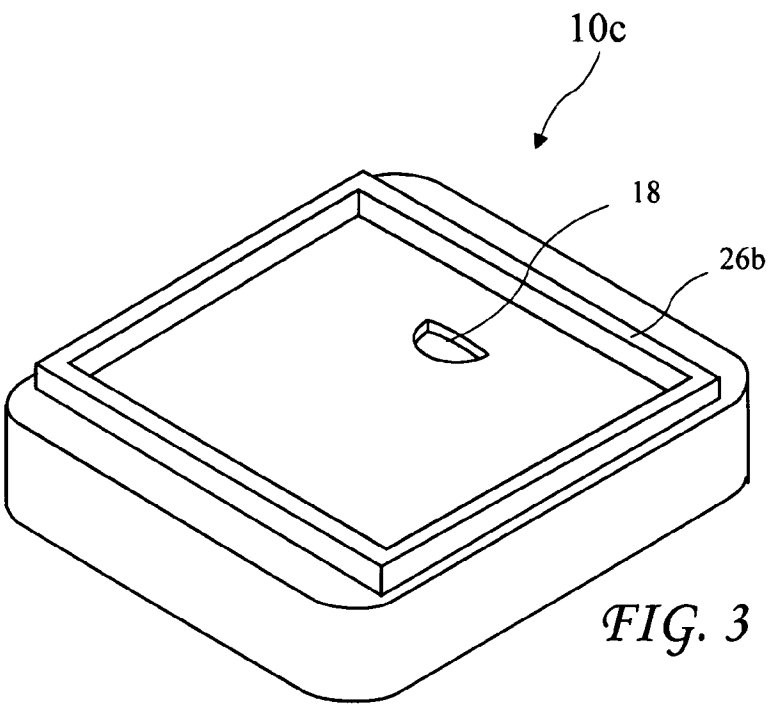
FIG. 3 is a bottom perspective view of a third embodiment of the vacuum cup according to the present invention.

A bottom perspective view of a second embodiment of the vacuum cup 10*b* according to the present invention is shown in FIG. 2, and a bottom perspective view of a third embodiment of the vacuum cup 10*c* according to the present invention is shown in FIG. 3. The vacuum cups 10*b* and 10*c* include alignment features 26*a* and 26*b* respectively. The alignment feature 26*a* is rounded or a bullnose shape, and the alignment feature 26*b* is rectangular. The alignment features 26*a* and 26*b* are suitable for use with know CNC machines, and are configured to cooperate with grooves in a flat table machine to position the vacuum cup on the flat table machine.

Figure 4B:
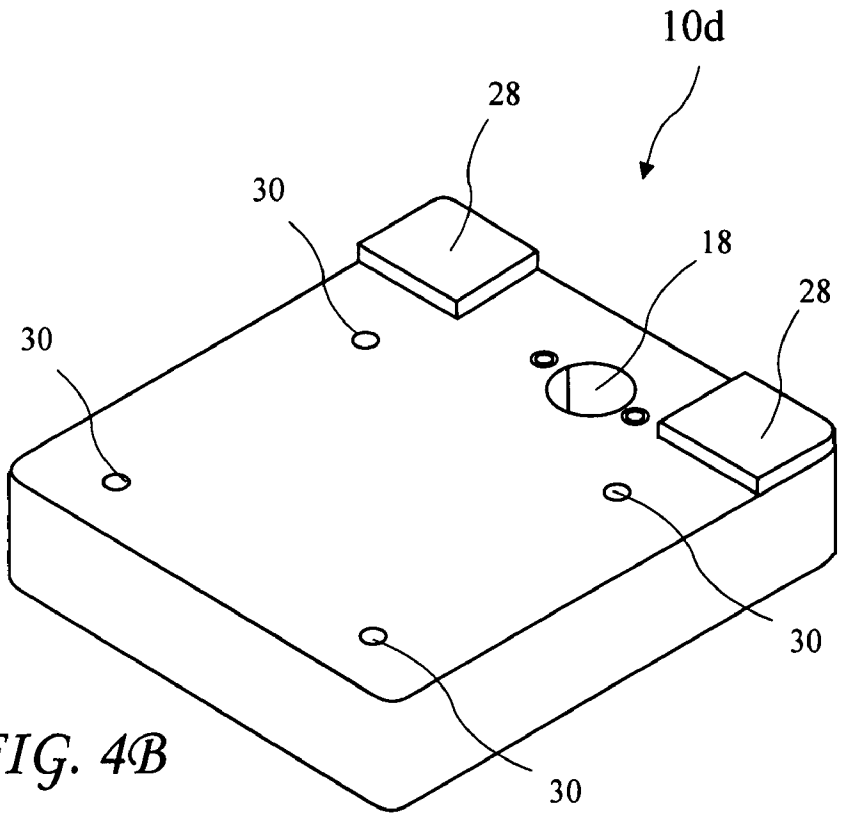
FIG. 4B is a bottom perspective view of the fourth embodiment of the vacuum cup according to the present invention.
Figure 4A:
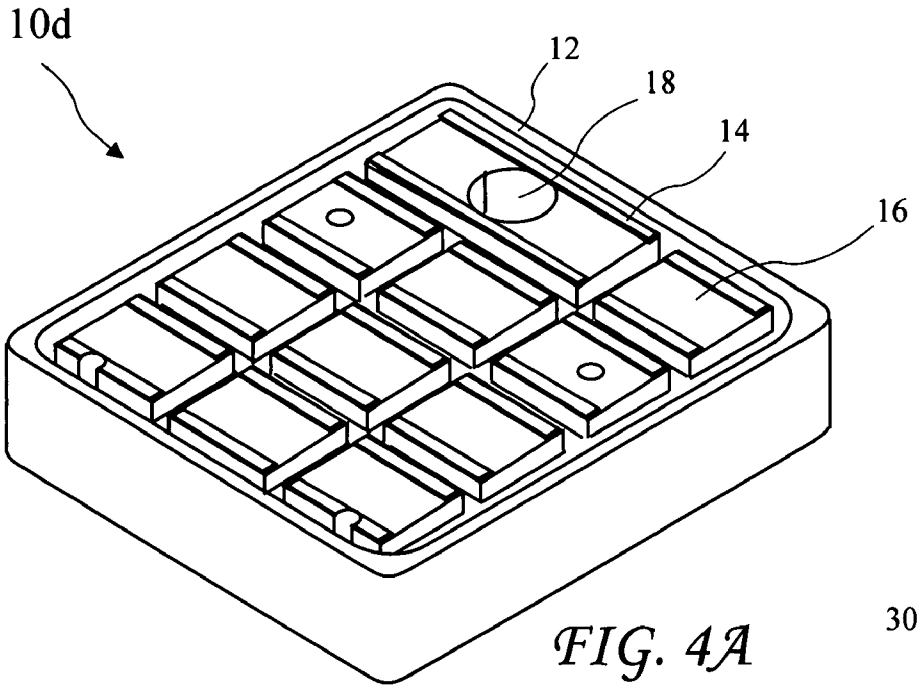
FIG. 4A is a top perspective view of a fourth embodiment of the vacuum cup according to the present invention.

A top perspective view of a fourth embodiment of the vacuum cup 10*d* according to the present invention is shown in FIG. 4A, and a bottom perspective view of the fourth embodiment of the vacuum cup 10*d* is shown in FIG. 4B. The vacuum cup 10*d* is similar to the vacuum cups 10*a*, 10*b*, and 10*c*, but includes side pads 28 along one edge of the vacuum cup bottom to cooperate with support rails of a machines. Such cup is used on machines such as a Biesse Rover 20 machine. The vacuum cup 10*d* further includes four fastener passages 30 for securing the cup to the machine.

Figure 5C:
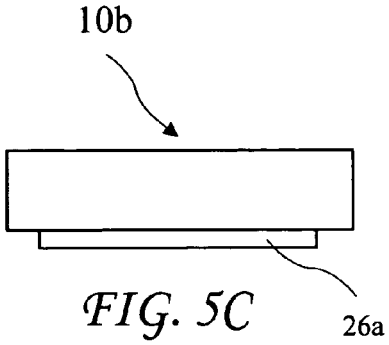
FIG. 5C is an end view of the second embodiment of the vacuum cup.
Figure 5A:
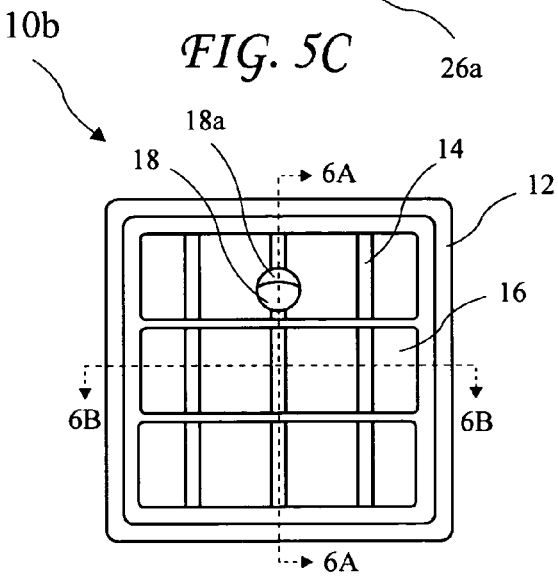
FIG. 5A is a top view of the second embodiment of the vacuum cup.
Figure 5B:
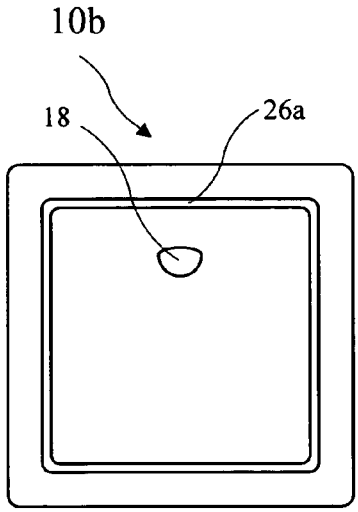
FIG. 5B is a bottom view of the second embodiment of the vacuum cup.
Figure 6A:
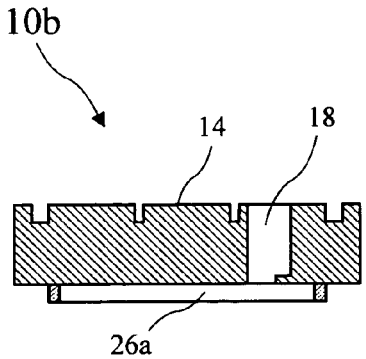
FIG. 6A is a cross-sectional view of the second embodiment of the vacuum cup taken along line 6A-6A of FIG. 5A.
Figure 6B:
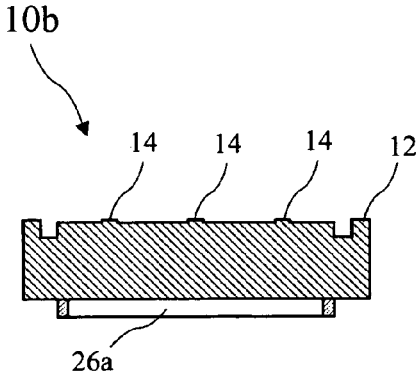
FIG. 6B is a cross-sectional view of the second embodiment of the vacuum cup taken along line 6B-6B of FIG. 5A.

A top view of the second embodiment of the vacuum cup 10*b* is shown in FIG. 5A, a bottom view of the second embodiment of the vacuum cup 10*b* is shown in FIG. 5B, and an end view of the second embodiment of the vacuum cup 10*b* is shown in FIG. 5C. A cross-sectional view of the second embodiment of the vacuum cup 10*b* taken along line 6A-6A of FIG. 5A is shown in FIG. 6A, and a cross-sectional view of the second embodiment of the vacuum cup 10*b* taken along line 6B-6B of FIG. 5A is shown in FIG. 6B. The raised edge 12 rises approximately 0.2 mm above the work piece supports 14.

Figure 7B:
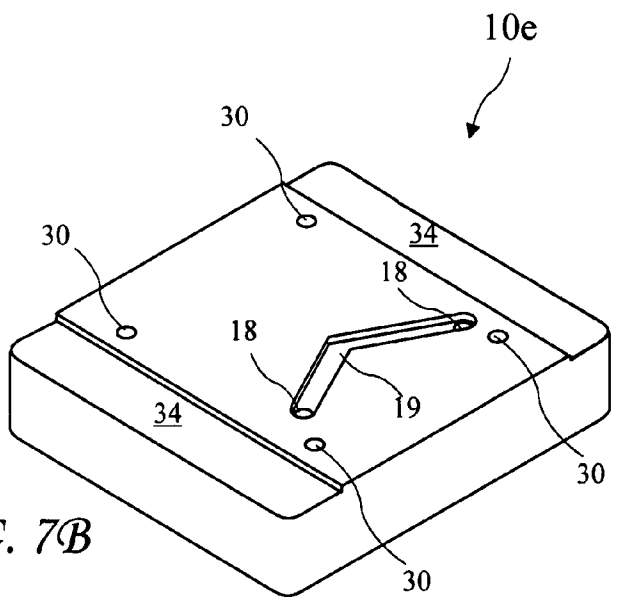
FIG. 7B is a bottom perspective view of the fifth embodiment of the vacuum cup according to the present invention.
Figure 7A:
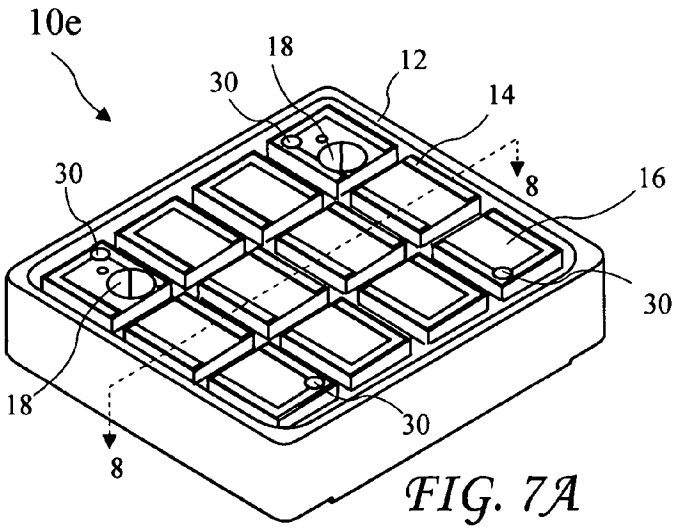
FIG. 7A is a top perspective view of a fifth embodiment of the vacuum cup according to the present invention.
Figure 8:
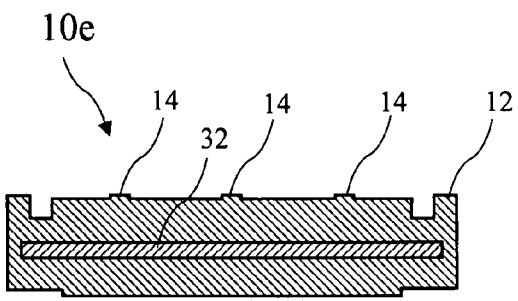
FIG. 8 is a cross-sectional view of the fifth embodiment of the vacuum cup taken along like 8-8 of FIG. 7A.

A top perspective view of a fifth embodiment of the vacuum cup 10*e* according to the present invention is shown in FIG. 7A, a bottom perspective view of the fifth embodiment of the vacuum cup 10*e* is shown in FIG. 7B, and a cross-sectional view of the fifth embodiment of the vacuum cup 10*e* taken along line 8-8 of FIG. 7A is shown in FIG. 8. The vacuum cup 10*e* is similar to the vacuum cups 10*a*, 10*b*, 10*c* and 10*d*, but includes recesses 34, a "V" shaped vacuum slot 19, and a support structure comprises an insert 32. The insert 32 is a plate embedding in the vacuum cup 10*e* and is preferably a nylon insert, and more preferably a Delrin® insert, and is preferably approximately ⅜ inches thick. The insert 32 is preferably etched to provide better adhesion of the rubber vacuum cup body to the insert 32, and more preferably the insert 32 is etched using plasma surface modification.

An example of a suitable plasma surface modification of the insert 32 is performed using a 2051 Series Plasma System made by TriStar Plastics, Corp. In Brea, Calif. Plasma is a state-of-matter which is different from the other three states (solid, liquid, or gas). In a steady state condition, plasma is a quasineutral cloud which contains free electrons and ions. In a disassociated state, plasma consists of electrons, ions, unexcited molecules and free radicals. Plasma may be generated by turning non-reactive molecules into reactive molecules by introducing energy, such as an electrical charge. Extremely reactive plasmas may be created by using an electrical charge to break up safe inert gases, for example, freons. When freons are electrified, they produce large quantities of chlorine and fluorine, both highly reactive compounds. These are the compounds which contain the ions and free radicals which actually do the "etching". In addition, the directionality and degree of reactivity can be controlled by the amount of applied power. The ability to control the directionality and degree of reactivity of the plasma etching process enables the engineer to "control the etch", which makes dry etching (e.g., plasma etching) more controllable than wet etching.

Methods for selecting parameters for plasma etching are well known to those skilled in the art. For plasma etching of the insert 32, the plasma pressure is preferably maintained between 0.05 Torr to 2.0 Torr, and more preferably between 0.250 Torr and 0.350 Torr. The RF power setting is preferably between 20 Watts to 2500 Watts, and more preferably between 800 Watts and 1,000 Watts. The RF generator frequency is variable, but is preferably approximately 13.56 MHz. The gas species used in this invention may be any pure gas or gas mixture which would provide an oxidized surface. Commonly preferred gasses include oxygen (O2), nitrous (N2O), argon (Ar), helium (He), carbon dioxide (C2O), or any mixture there of. The duration of the treatment is variable based on polymer load (i.e., the quantity of polymer parts in the chamber to be treated) and surface area of the polymer load. Based on standard polymer load, and size of substrate the time is preferably between 2 to 45 min, and more preferably, the time is between 15 minutes to 25 minutes. Those skilled in the art would generally modify the time for their specific machine setup.

After a substrate has been treated using the above method, the surface is molecularly etched and chemically modified. This type of surface activation can be measured via goniometry (contact angle measurement) or dynes inks.

The governing equation is Young's equation where:

$$Ysv - Ysl = Ylv * \cos\Theta$$

where Ysv is the surface free energy of the solid in contact with vapor, Ysl is the surface free energy of the solid covered with liquid, Ylv is the surface free energy of the liquid-vapor, and interface Θ is the contact angle.

Contact angles are measured in degrees. "Low" is below about 20° and "high" as 90° or above. Water on poly-tetrafluoroethylene PTFE is about 112°, very high. Low angles mean wettable. Surface energy (the terminology generally used for solids) and surface tension (the terminology generally used for fliuds) are measured in dynes/cm. Water has a surface tension of 72.8 dynes/cm at room temperature. The surface energy of most solids falls between 15 and 100 dynes/cm. If the surface tension of the fluid is below the surface energy of the solid, the fluid will spread rather than staying in a little droplet. Polymer surfaces are often treated to improve this wettability by raising their surface energy.

Figure 9:
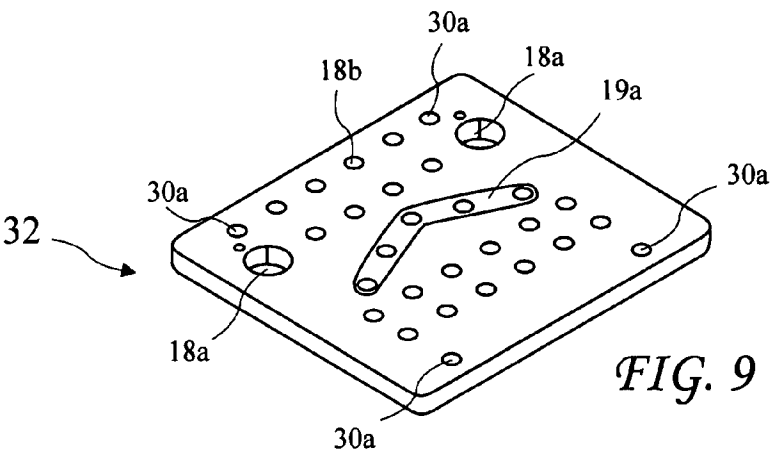
FIG. 9 is an insert molded into a vacuum cup to reduce or prevent bending which may cause vacuum leaks.

A detailed top perspective view of the insert 32 is shown in FIG. 9. The insert 32 is preferably made or pre-drilled with passages 30*a* aligned with the fastener passages 30 and passages 18*a* aligned with the vacuum passages 18 in the vacuum cup to simplify molding the vacuum cup 10*e*. The fastener passages 30*a* and the vacuum passages 18*a* are preferably over-sized to allow inside edges of the fastener passages 30*a* and the vacuum passages 18*a* to be embedded within the vacuum cup. The outside dimensions of the insert 32 are undersized compared to the vacuum cup to allow embedding of the insert 32 within the vacuum cup. Additional holes 18*b* (one of a multiplicity of holes 18*b* is labeled in FIG. 9) are spaced apart on the insert 32 to allow molding material to flow through the insert 32 to prevent the vacuum cup from ballooning when vacuum is applied thereto. A second "V" shaped vacuum slot 19*a* may be provided in the insert 32, for example, to distribute vacuum and several of the holes 18*b* may be aligned with the slot 19*a* to help distribute vacuum.

While the invention herein disclosed has been described by means of specific embodiments and applications thereof, numerous modifications and variations could be made thereto by those skilled in the art without departing from the scope of the invention set forth in the claims.

I claim:

1. A vacuum cup comprising:

a flexible rubber body having a bottom surface, a top surface fixedly aligned above the bottom surface, and sides wherein said body has a volume with a substantially rectangular shape;

a vacuum area formed on the top surface of the rubber body;

features on the bottom surface of the rubber body for mounting the vacuum cup directly to a machine the vacuum cup is used with wherein said features is an integral projection formed on each side of said bottom on at least two opposite sides;

a fixed vacuum passage passing between the bottom surface and the vacuum area; and raised edges molded into the rubber body around the top surface of the body for coming in direct contact with a work piece to form a seal with the work piece wherein said raised edges includes recessed intersecting channels in said top surface.

2. The vacuum cup of claim 1, wherein the vacuum area includes fixed work piece supports molded into the rubber body.

3. The vacuum cup of claim 2, wherein the work piece supports are slightly below the raised edge.

4. The vacuum cup of claim 3, wherein the work piece supports are approximately 0.2 mm below the raised edge.

5. The vacuum cup of claim 2, wherein the work piece supports are parallel bars.

6. The vacuum cup of claim 2, wherein the rubber body includes a substantially solid structure between the work piece supports and the body bottom surface to resist flexing due to vacuum and to work piece weight.

7. The vacuum cup of claim 1, wherein the rubber body consists essentially of molded rubber.

8. The vacuum cup of claim 1, wherein the rubber body is a substantially solid rubber body.

9. The vacuum cup of claim 8, wherein the rubber body is approximately one inch thick.

10. The vacuum cup of claim 1, wherein the rubber body is molded from rubber having a Shore hardness of approximately 85.

11. The vacuum cup of claim 1, wherein the bottom surface includes mounting features.

12. The vacuum cup of claim 11, wherein the mounting features comprise a rectangular ridge configured to cooperate with grooves in a flat table machine to position the vacuum cup on the flat table machine.

13. The vacuum cup of claim 1, wherein the rubber is a non-blooming rubber.

14. A vacuum cup comprising:

a single piece body made from flexible material and having a bottom surface, a top surface, and sides wherein said body has a volume with a substantially rectangular shape;

a vacuum area formed on the top surface;

features on the bottom surface of the rubber body for mounting the vacuum cup directly to a machine the vacuum cup is used with wherein said features is an integral protection formed on each side of said bottom on at least two opposite sides;

a vacuum passage passing between the bottom surface and the vacuum area;

a raised edges molded into the rubber body around the top surface of the body coming in direct contact with a work piece to form a seal with the work piece wherein said raised edges includes recessed intersecting channels in said top surface.

15. A vacuum cup comprising:

a single piece natural rubber body having a bottom surface, a top surface, and sides wherein said body has a volume with a substantially rectangular shape;

a vacuum area formed on the top surface;

features on the bottom surface for mounting the vacuum cup directly to a machine the vacuum cup is used with wherein said features is an integral protection formed on each side of said bottom on at least two opposite sides;

a vacuum passage passing between the bottom surface and the vacuum area;

raised edges molded into the rubber body around the top surface of the body coming in direct contact with a work piece to form a seal with the work piece wherein said raised edges includes recessed intersecting channels in said too surface; and work piece supports residing lower than the raised edge.

16. The vacuum cup of claim 15, wherein application of a vacuum to the vacuum cup causes the raised edge to compress and a supported workpiece to reside against the work piece supports.

17. The vacuum cup of claim 15, wherein the natural rubber body is a flexible natural rubber body.

18. The vacuum cup of claim 15, wherein the natural rubber body has a shore hardness of approximately 80 A.

* * * * *